US006341945B1

(12) United States Patent
Hugenroth et al.

(10) Patent No.: US 6,341,945 B1
(45) Date of Patent: Jan. 29, 2002

(54) SCROLL COMPRESSOR WITH REDUCED CAPACITY AT HIGH OPERATING TEMPERATURES

(75) Inventors: Jason J. Hugenroth; Thomas R. Barito, both of Arkadelphia, AR (US)

(73) Assignee: Scroll Technologies, Arkadelphia, AR (US)

( * ) Notice: Subject to any disclaimer, the term of this patent is extended or adjusted under 35 U.S.C. 154(b) by 0 days.

(21) Appl. No.: 09/419,651

(22) Filed: Oct. 18, 1999

(51) Int. Cl.[7] ..... F04B 49/00
(52) U.S. Cl. ..... 417/214; 418/14
(58) Field of Search ..... 417/292, 213, 417/212, 214, 310, 301, 32; 418/55.5, 55.2, 14

(56) References Cited

U.S. PATENT DOCUMENTS 4,596,520 A * 6/1986 Arata et al. ..... 418/55.5
4,840,545 A * 6/1989 Moilanen ..... 417/301
5,169,294 A * 12/1992 Barito ..... 417/310
5,290,154 A * 3/1994 Kotlarek et al. ..... 417/292
5,516,267 A * 5/1996 Ikeda et al. ..... 418/14
5,520,524 A * 5/1996 Takemoto et al. ..... 418/14
5,520,527 A * 5/1996 Kim ..... 418/55.5
5,527,158 A * 6/1996 Ramsey et al. ..... 417/32
5,607,288 A 3/1997 Wallis et al.
5,803,723 A * 9/1998 Suefuji et al. ..... 418/55.2

* cited by examiner

*Primary Examiner*—Teresa Walberg
*Assistant Examiner*—Quang Van
(74) *Attorney, Agent, or Firm*—Carlson, Gaskey & Olds

(57) ABSTRACT

A number of embodiments are disclosed in which scroll compressor elements are actuated upon a particular condition being sensed within the scroll compressor. Upon the condition being sensed, elements are actuated which restrict the orbit radius of the orbiting scroll. In this way, conditions such as low charge, reverse rotation, and low suction pressure are encountered with little damage to the scroll compressor.

20 Claims, 4 Drawing Sheets

SCROLL COMPRESSOR WITH REDUCED CAPACITY AT HIGH OPERATING TEMPERATURES

BACKGROUND OF THE INVENTION

This invention relates to a scroll compressor in which the capacity of the compressor is reduced when the temperature of the refrigerant becomes high. High temperature is indicative of a low charge, loss of charge or reverse rotation, and the reduction of the capacity provides a protective function.

Scroll compressors are becoming widely utilized in refrigerant compression applications. In a scroll compressor, a pair of scroll members each having a base and a spiral wrap extending from the base are placed facing each other. The spiral wraps of the two scroll members interfit to define compression chambers. One of the two scroll members is caused to orbit relative to the other, and the spiral wraps define decreasing volume compression chambers as the one scroll member orbits relative to the other.

Scroll compressors raise many design challenges. One challenge relates to operation of the scroll compressor when the charge of refrigerant becomes low. In such so-called "loss of charge" operation, the temperature of the refrigerant becomes undesirably high. The temperature also can be high during reverse rotation, low suction pressure operation or other abnormal conditions. Damage can result to the components of the scroll compressor from the high temperatures.

Thus, it would be desirable to have a mechanism for protecting the scroll compressor in a loss of charge situation.

Reduced capacity systems are known for scroll compressors. However, the reduced capacity systems have generally been used to achieve a reduced capacity when a variable outside of the compressor indicates a need for a reduced charge. Thus, if a control decides that the cooling capacity, as an example, is low, then the capacity of the compressor may be reduced.

Similar problems are encountered during low suction pressure operation, reverse running operation, or other conditions which could result in an elevated temperature.

SUMMARY OF THE INVENTION

In a disclosed embodiment of this invention, an internal condition in the scroll compressor is sensed, and the capacity of the compressor is reduced in response to that sensed condition. Preferably the orbit radius of the orbiting scroll is reduced upon the condition being sensed.

In several embodiments, a bi-metal or shape memory alloy metal component does not actuate the orbit reduction until a predetermined temperature is reached. If the predetermined temperature is reached, then a component is actuated which reduces the orbit radius. As one example, a pin is fixed in the orbiting scroll, and extends upwardly into a chamber in the non-orbiting scroll. A cap which has a ramped inner surface is biased away from the pin, and received in the chamber. Discharge pressure refrigerant is selectively tapped to the reverse side of the cap. A bi-metal valve prevents flow of the discharge pressure to the chamber under normal operating conditions. However, if the temperature becomes high, then the bi-metal valve allows flow of discharge pressure to the chamber, and the cap is biased downwardly such that it prevents the full orbiting movement of the pin. When the pin's orbiting movement is restricted, the orbit movement of the orbiting scroll is also restricted.

In a second embodiment, the pin is offset relative to the axis of the chamber. The cap includes an eccentric passage which selectively receives the pin. Normally, the cap is biased away from the pin. However, when the discharge pressure is directed into the chamber, the cap is biased downwardly to contact the pin. At this time, the orbiting radius of the orbiting scroll is reduced.

In another embodiment, a suction pressure is tapped to one side of a pin-piston. A spring also biases the pin-piston upwardly into a groove in the rear face of the orbiting scroll. The pin-piston is movable within the back pressure chamber of the scroll. The back pressure chamber is typically at an intermediate compressed pressure. Thus, the intermediate pressure is normally sufficiently high such that the pin-piston is biased downwardly and is not moved into the groove.

In a low charge, low suction pressure, and reverse running situations, the suction pressure approaches the intermediate compressed pressure. In these conditions, the spring will bias the pin-piston upwardly into the groove. Thus, the orbiting radius of the orbiting scroll is reduced.

A similar embodiment, rather than utilizing suction pressure versus intermediate pressure, a bi-metal element is utilized which selectively biases the pin upwardly when the refrigerant reaches an elevated temperature.

In another embodiment of this invention, a pin-piston is received in a groove in a base of the orbiting scroll. A first torsion spring twists the pin in a first direction. A second shape memory alloy tends to bias the pin in a second direction. Under normal "relaxed" conditions, the torsion spring overcomes the force from the shape memory alloy, and the pin is biased to a position at which it does not affect the orbit of the orbiting scroll. However, upon an elevated temperature being encountered in the refrigerant, the shape memory alloy increases its force on the pin, and the pin is moved to a position at which it reduces the orbiting radius of the orbiting scroll.

In another embodiment, a fluid-filled bellows forces a shim outwardly against a pin received in the orbiting scroll. The fluid filled bellows is normally retracted under normal operating temperatures. However, upon the occurrence of an elevated temperature, the bellows expands forcing the shim against the orbiting pin. This would then reduce the orbiting radius of the orbiting scroll.

In yet another embodiment, a shape memory alloy actuator selectively forces a pin radially outwardly to contact the Oldham coupling. Thus, upon the occurrence of an elevated temperature, the pin is forced outwardly to contact the Oldham coupling. This limits the reciprocating movement of the Oldham coupling, and consequently limits the orbit radius of the orbiting scroll.

In general, the present invention discloses a number of embodiments wherein the orbit radius of the orbiting scroll is limited by elements which are actuated upon a sensed condition within the orbiting scroll.

These and other features of the present invention can be best understood from the following specification and drawings, the following of which is a brief description.

DETAILED DESCRIPTION OF A PREFERRED EMBODIMENT

Figure 1A:
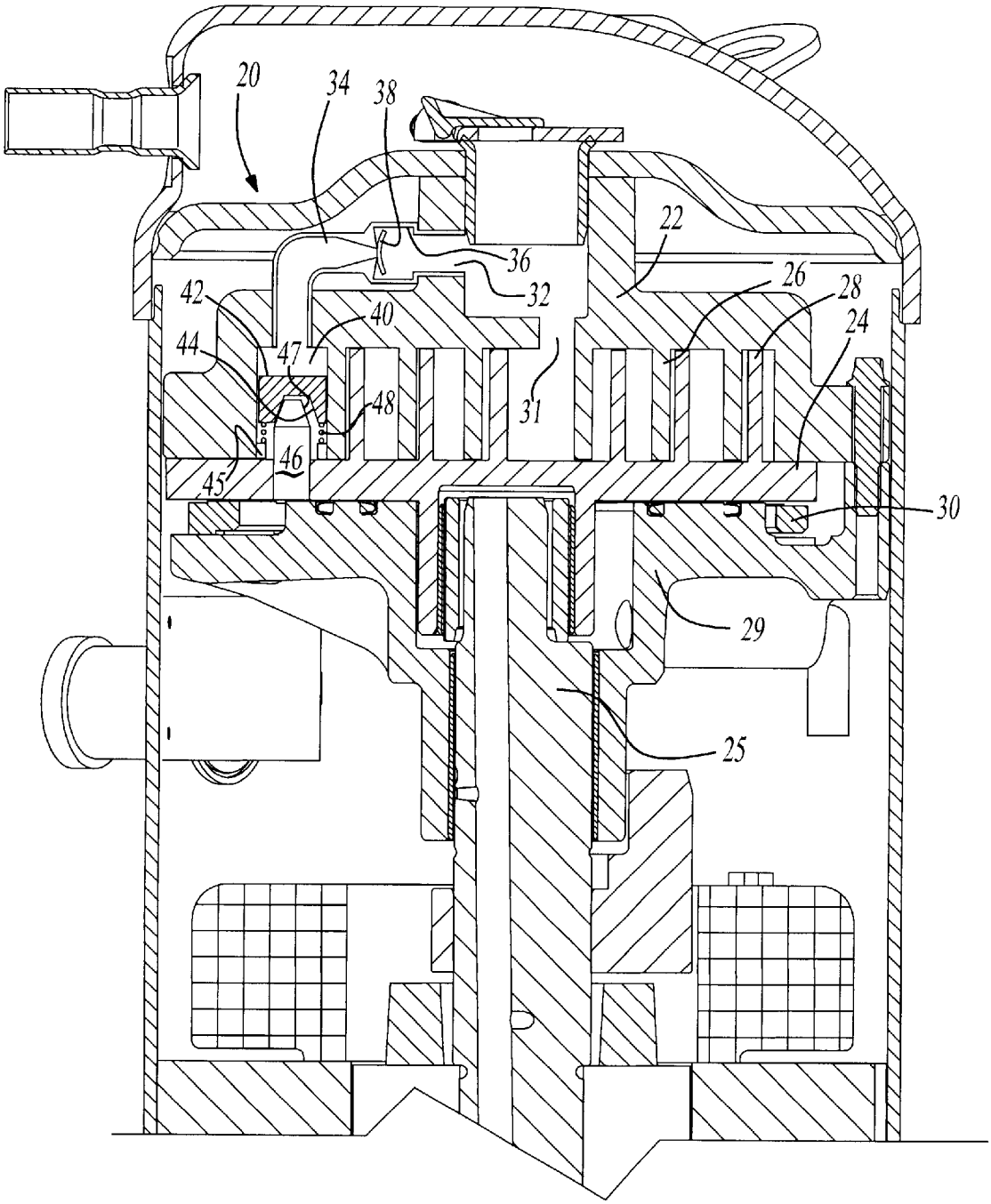
FIG. 1A is a cross-sectional view of a first embodiment scroll compressor.

FIG. 1A shows a scroll compressor 20 incorporating a non-orbiting scroll 22 and an orbiting scroll 24. A shaft 25 drives the orbiting scroll 24 to orbit relative to the non-orbiting scroll 22. Interfitting wraps 26 and 28 define compression chambers which decrease in volume as the orbiting scroll 24 orbits. An Oldhain coupling 30, shown schematically, causes the orbiting scroll to orbit when it is driven by the rotating shaft 25.

A discharge pressure port 31 extends through the base of the non-orbiting scroll 22 and communicates to a tap 32. Tap 32 extends through a pipe 34. An intermediate valve chamber 36 receives a bi-metal or shape memory valve 38. Under normal operating conditions of the scroll compressor, the valve 38 closes communication between tap 32 and pipe 34.

A chamber 40 communicates with the pipe 34. A cap 42 has an inner ramp surface 44. An end shoulder 45 provides a bias surface for a spring 48, tending to bias the cap 42 upwardly towards the top of the chamber 40. A pin 46 is received in the orbiting scroll 24.

Figure 1B:
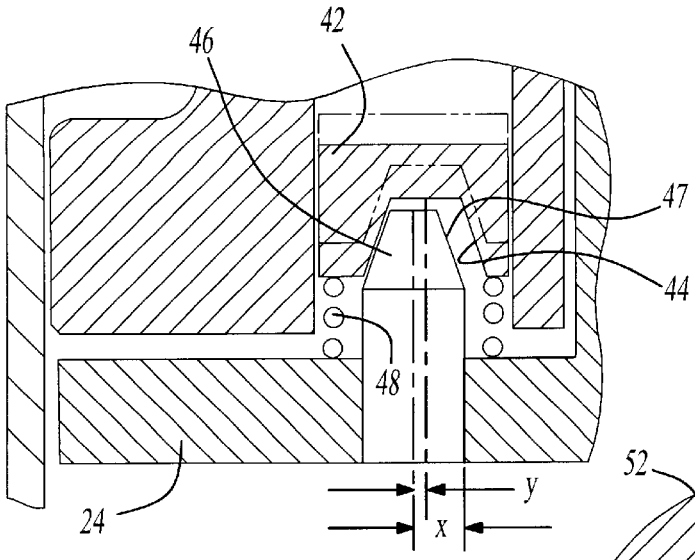
FIG. 1B is an enlarged view of the first embodiment.

As can be appreciated from FIG. 1B, the ramp surface 44 can cam off of the ramped top of the pin 46. This will limit the orbiting movement of the pin 46, and thus the orbiting movement of the orbiting scroll 24.

Under periods of normal operation, the valve 38 is closed and discharge pressure cannot communicate to the chamber 40. Spring 48 biases cap 42 upwardly, and the cap 42 does not restrict orbiting movement of pin 46. Orbiting scroll 24 can thus orbit through its entire normal orbit radius.

However, if an elevated temperature is seen in the scroll compressor chamber, the valve 38 moves to its actuated position. Valves formed of a bi-temperature metal, or a shape memory alloy having the ability to move to an actuated position once a predetermined elevated temperature is reached are known. The valve structure itself forms no portion of this invention. When the valve moves to the actuated position, discharge pressure communicates to the chamber 40, and the cap 42 is driven downwardly. In this position, such as shown in FIG. 1B, the orbiting radius of the pin 46, and thus the orbiting scroll 24 is limited. In this way, the capacity of the compressor is limited. Since the elevated temperature is indicative of some problem in the overall operation of the scroll compressor, limiting the capacity serves to protect the scroll compressor.

Figure 2A:
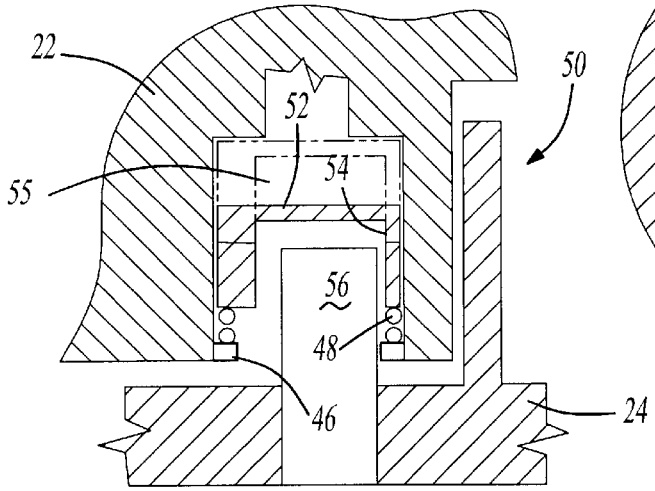
FIG. 2A shows a second embodiment.

FIG. 2A shows another embodiment 50. In embodiment 50, the cap 52 has a bore 54 which is eccentric relative to the center of the chamber 55. The pin 56 is received off-center within the bore 54. As shown in phantum normally, the bore 54 does not contact or restrict movement of the pin 56.

Figure 2B:
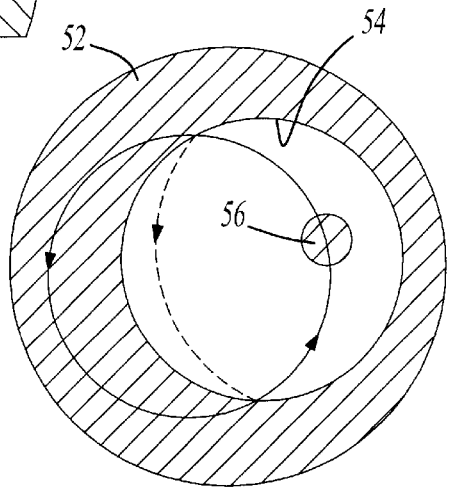
FIG. 2B is a top view of the second embodiment.

However, as can be appreciated from FIG. 2B, when the pin 56 moves through its normal orbiting path, it moves beyond the inner periphery of the bore 54. This is allowed under normal operating circumstances since the cap 54 will be biased upwardly towards the top of chamber 55, and the bore 54 would not restrict orbiting movement of the pin 56.

However, when the valve 38 is actuated and discharge pressure reaches the chamber 55, the cap 52 is forced downwardly. In this position, the orbiting movement of the pin 56 is limited. This is shown in dotted line in FIG. 2B.

Figure 3:
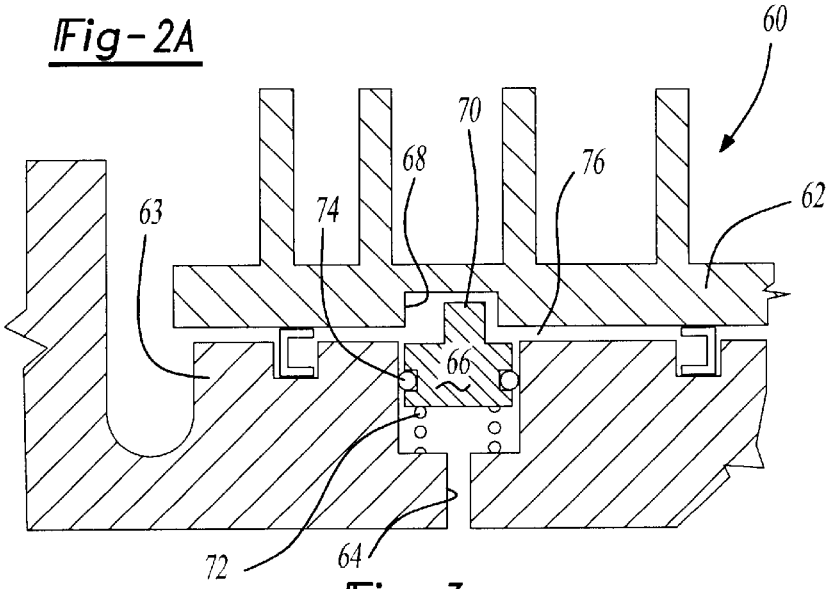
FIG. 3 shows a third embodiment.

FIG. 3 shows another embodiment 60. In embodiment 60 the crankcase 63 has a tap 64 tapping suction pressure through the crankcase 63. A pin-piston 66 has an upper pin finger 70 selectively moved into a channel 68 in the rear of the base of the orbiting scroll 62. A spring 72 biases the pin-piston 66 upwardly towards the channel 68. When the pin finger 70 is received in channel 68, it restricts the free orbiting movement of the orbiting scroll 62, as with the above embodiments. A seal 74 is shown on the outer periphery of the pin-piston 66. As can be appreciated, the pin-piston 66 is received within the back pressure chamber 76 of the scroll 60.

During normal operating conditions, the pressure in the chamber 76 greatly exceeds the suction pressure at tap 64. Thus, the pin-piston 66 is biased downwardly, and the pin finger 70 is removed from the groove 68. However, during low charge, reverse operation, or low suction pressure operation, the pressure in the chamber 76 will begin to approach the pressure at tap 64. The spring 72 now becomes the greatest factor in controlling movement of the pin-piston 66. The pin-piston 66 is then forced upwardly towards the groove 68, and finger 70 restricts orbiting movement of the orbiting scroll 62.

Figure 4:
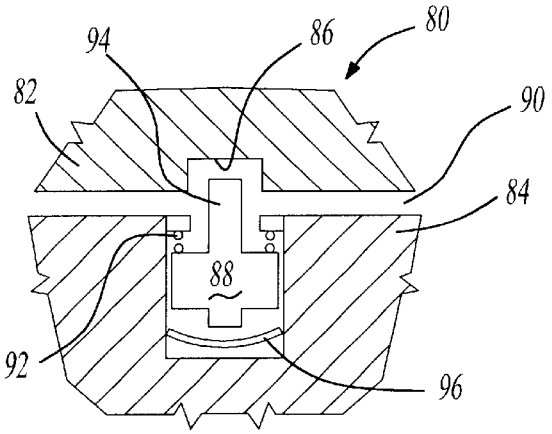
FIG. 4 shows a fourth embodiment.

FIG. 4 shows a similar embodiment 80 wherein the orbiting scroll 82 is positioned adjacent the crankcase 84. The groove 86 selectively receives the pin-piston 88. The back pressure chamber 90 communicates to contact a bi-metal element 96, such that when the gas in the chamber 90 reaches an elevated temperature, it will actuate the bi-element 96. In the actuated position, the pin-piston 88 is forced upwardly against the force of spring 92 and into the groove 86. Once in the groove 86, the pin-piston 94 limits the orbiting movement of the orbiting scroll 82.

Figure 5B:
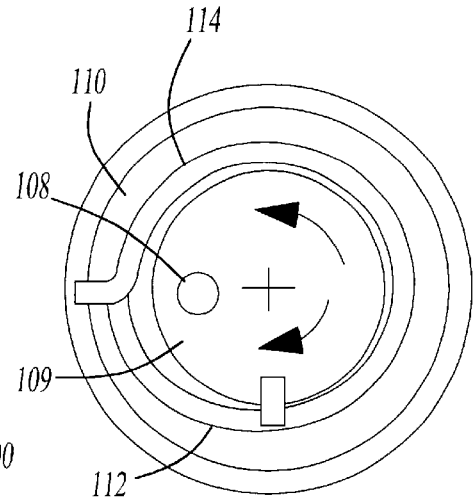
FIG. 5B is a top view of the fifth embodiment.
Figure 5A:
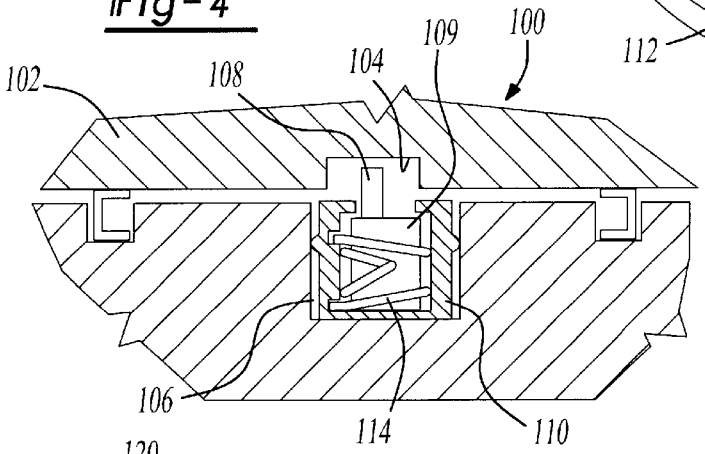
FIG. 5A shows a fifth embodiment.

FIG. 5A shows yet another embodiment 100 wherein the orbiting scroll 102 has a groove 104. A chamber 106 is formed in the crankcase. A piston finger 108 is formed on a piston 109. A holder 110 receives a torsion spring 112 and a shape memory alloy spring 114.

As can be appreciated from FIG. 5B, the torsion spring twists the pin finger 108 to a position where it does not contact the groove 104 during the full orbiting movement of the orbiting scroll 102. However, if an elevated temperature is reached, the shape memory alloy spring 104 increases its torque and twists the pin 108 to a position at which it does contact the inner surface of the groove 104. Thus, the full orbiting movement of the orbiting scroll 102 is restricted.

Figure 6A:
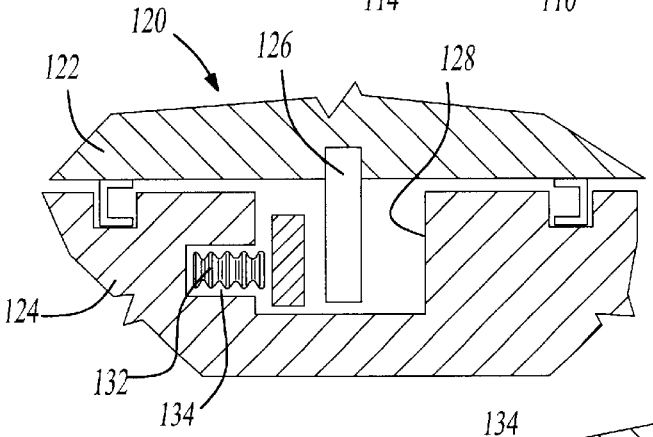
FIG. 6A shows a sixth embodiment.

FIG. 6A shows another embodiment 120 wherein the orbiting scroll 122 has a pin extending into crankcase 124. Pin 126 extends downwardly from the base of the orbiting scroll 122 into groove 128 formed in the crankcase 124. A shim 130 is positioned outwardly of a fluid-filled bellows 132 received in a bore 134. The fluid filled bellows 132 is normally retracted at normal operating temperatures. Thus, the shim 130 is not biased against the pin 126, and the orbiting scroll 122 is allowed to move through its full orbiting radius.

Figure 6B:
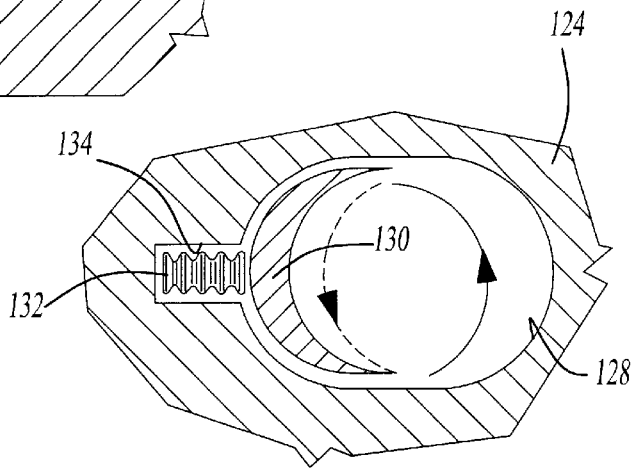
FIG. 6B is a top view of the sixth embodiment.

However, if the temperature in the compressor increases, the fluid-filled bellows 132 will expand as shown in FIG. 6B. The shim 134 is forced outwardly, and does contact the orbiting pin 126, reducing the orbiting radius of the orbiting scroll 122.

Figure 7:
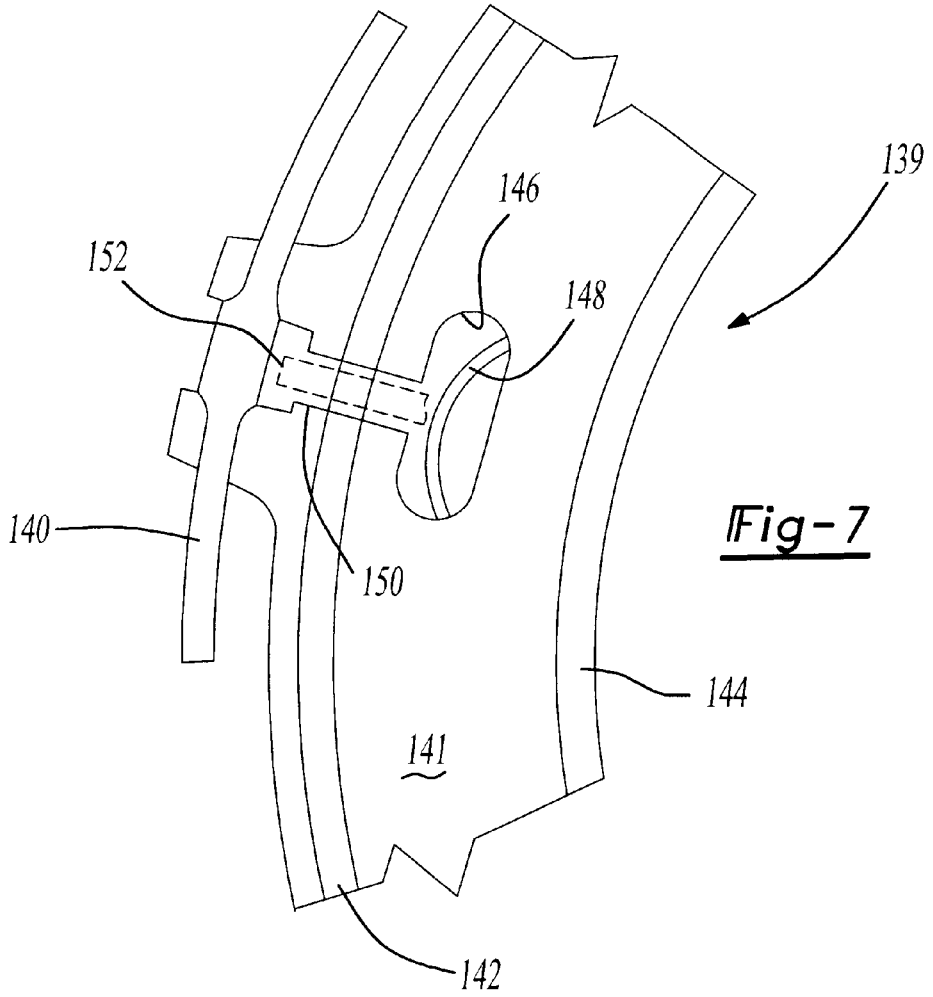
FIG. 7 shows a seventh embodiment.

FIG. 7 shows yet another embodiment 139. In embodiment 139, the Oldham coupling key 140 is positioned just outwardly of an outer seal groove 142, which defines the back pressure chamber 141 with a second inner seal 144. An opening 146 communicates gas from the back pressure chamber 141 into a chamber receiving a shaped memory alloy spring 148. Shape memory alloy spring 148 selectively biases the pin 152 radially outwardly through a bore 150.

Figure 8A:
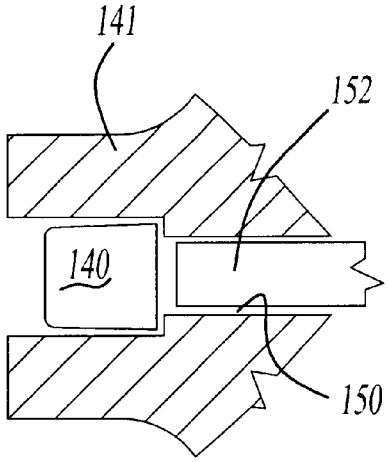
FIG. 8A shows one detail of the seventh embodiment.

As shown in FIG. 8A, in a non-actuated position the pin 152 does not contact the key 140. In this position, the Oldham coupling key, and hence the orbiting scroll, are both allowed to move through a full orbiting radius.

Figure 8B:
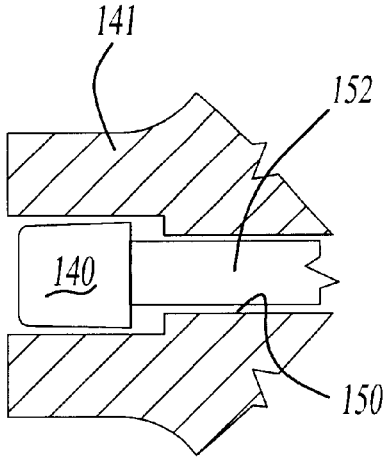
FIG. 8B shows a seventh embodiment in an actuated position.

However, as shown in FIG. 8B, the pin 152 has been forced outwardly by actuation of the shape memory alloy spring 148. In this position, the Oldham coupling key 140 is restricted in its movement, and thus the radius of the orbiting scroll will be reduced.

In general, the present invention discloses a number of scroll compressor embodiments wherein the orbit radius of the orbiting scroll is reduced in response to an internal condition. This will prevent damage to the scroll compressor, and thus better protect the scroll compressor.

Although preferred embodiments have been disclosed, a worker in this art would recognize that certain modifications would come within the scope of this invention. For that reason, the following claims should be studied to determine the true scope and content of this invention.

What is claimed is:

1. A scroll compressor comprising a first scroll member having a base and a generally spiral wrap extending from said base;

a second scroll member having a base and a generally spiral wrap extending from said base;

a shaft for driving said second scroll member to orbit relative to said first scroll member;

a sealed housing enclosing said first and second scroll members on said shaft; and a mechanism for limiting the orbit radius of said second scroll member relative to said first scroll member, said mechanism being actuated in response to a condition internal to said sealed compressor, said mechanism limiting said orbit radius of said second scroll member between at least a greater and a smaller orbit radius, with said second scroll member continuing to orbit at each of said orbit radii as controlled by said mechanism, and with said internal condition being a condition of a refrigerant being compressed between said first and second scroll members.

2. A scroll compressor as recited in claim 1, wherein an element is selectively moved into a groove at which it restricts movement of said orbiting scroll.

3. A scroll compressor as recited in claim 2, wherein said element is moved upwardly from a crankcase into said orbiting scroll.

4. A scroll compressor as recited in claim 3, wherein said compressed pressure biases said element downwardly away from a groove, and a suction pressure biases said element towards a position where said orbit radius is restricted, a spring also biasing said element towards a restricted position.

5. A scroll compressor as recited in claim 2, wherein said element is moved based upon a difference in pressure between a suction pressure and the compressed pressure.

6. A scroll compressor as recited in claim 2, wherein said element is biased upwardly by a bi-metal element, which is movable to an actuated position once a predetermined temperature is reached, and at which a restricting element is received in a groove in said second scroll member such that said second scroll member orbiting radius is reduced.

7. A scroll compressor as recited in claim 1, wherein an Oldham coupling selectively controls the orbiting movement of said second scroll member, and said mechanism including an element which restricts the movement of said Oldham coupling, thus restricting the orbiting movement of said second scroll member.

8. A scroll compressor as recited in claim 7, wherein an element selectively biases a pin against said Oldham coupling, said element being actuated upon having reached a predetermined temperature.

9. A scroll compressor as recited in claim 1, wherein said mechanism includes a pair of spring members, with an element extending upwardly into a groove in said orbiting scroll, and said pair of spring members including at least one spring member which changes a torque on said element as temperature increases, and such that when a predetermined temperature is reached, said temperature sensitive spring moves said element to a position at which it restricts the radius of the orbiting scroll.

10. A scroll compressor as recited in claim 1, wherein a fluid-filled bellows selectively biases a member into contact with a pin received in said orbiting scroll to restrict orbiting movement.

11. A scroll compressor comprising:

a first scroll member having a base and a generally spiral wrap extending from said base;

a second scroll member having a base and a generally spiral wrap extending from said base;

a shaft for driving said second scroll member to orbit relative to said first scroll member;

a sealed housing enclosing said first and second scroll members on said shaft;

a mechanism for limiting the orbit radius of said second scroll member relative to said first scroll member, said mechanism being actuated in response to a condition internal to said sealed compressor; and said mechanism includes an element which moves between two positions based upon having reached a particular temperature.

12. A scroll compressor as recited in claim 11, wherein a bi-metal is utilized which is movable between an actuated and a non-actuated position upon having reached a predetermined temperature.

13. A scroll compressor as recited in claim 12, wherein said bi-metal element is utilized as a valve.

14. A scroll compressor as recited in claim 13, wherein said bi-metal valve selectively controls the flow of high pressure fluid to a chamber at which it biases a tap member towards a pin to restrict movement of said pin, and said pin being positioned to restrict movement of said orbiting scroll when the movement of said pin is restricted.

15. A scroll compressor as recited in claim 14, wherein said pin is fixed to orbit with said orbiting scroll.

16. A scroll compressor as recited in claim 14, wherein said pin extends downwardly into a crankcase which supports said orbiting scroll.

17. A scroll compressor as recited in claim 14, wherein said pin extends upwardly into a chamber in said non-orbiting scroll.

18. A scroll compressor as recited in claim 14, wherein said cap has a ramped inner surface and said pin has a ramped outer surface.

19. A scroll compressor as recited in claim 18, wherein said cap inner surface is offset relative to said pin.

20. A scroll compressor comprising:

a first scroll member having a base and a generally spiral wrap extending from said base;

a second scroll member having a base and generally spiral wrap extending from said base, said first and second scroll member wraps interfitting to define compression chambers;

a shaft for selectively driving said second scroll member to orbit relative to said first scroll member about an orbit radius;

a pin member and a groove, said pin member and said groove selectively interfitting to limit said orbiting radius of said orbiting scroll, one of said pin and said groove being received in said second scroll member.

* * * * *